US010079447B1

(12) United States Patent
Youtsey

(10) Patent No.: US 10,079,447 B1
(45) Date of Patent: Sep. 18, 2018

(54) COAXIAL CABLE CONNECTOR WITH AN EXPANDABLE PAWL

(71) Applicant: PCT International, Inc., Mesa, AZ (US)

(72) Inventor: Timothy L. Youtsey, Tempe, AZ (US)

( * ) Notice: Subject to any disclaimer, the term of this patent is extended or adjusted under 35 U.S.C. 154(b) by 0 days.

(21) Appl. No.: 15/656,959

(22) Filed: Jul. 21, 2017

(51) Int. Cl.
*H01R 13/58* (2006.01)
*H01R 24/38* (2011.01)
*H01R 103/00* (2006.01)

(52) U.S. Cl.
CPC ..... *H01R 13/5804* (2013.01); *H01R 24/38* (2013.01); *H01R 2103/00* (2013.01)

(58) Field of Classification Search
CPC ..... H01R 13/5804
See application file for complete search history.

(56) References Cited

U.S. PATENT DOCUMENTS 3,199,061 A 8/1965 Johnson et al.
4,022,966 A * 5/1977 Gajajiva ..... H01R 4/646 174/653
4,150,250 A * 4/1979 Lundeberg ..... H02G 3/065 174/655
4,377,320 A * 3/1983 Lathrop ..... H01R 24/40 439/585
4,490,576 A * 12/1984 Bolante ..... H02G 3/0616 174/655
4,990,106 A 2/1991 Szegda
5,059,747 A * 10/1991 Bawa ..... H02G 3/0675 174/541
5,393,244 A 2/1995 Szegda
5,466,173 A 11/1995 Down
5,498,175 A 3/1996 Yeh et al.
5,501,616 A 3/1996 Holliday
5,529,522 A * 6/1996 Huang ..... H01R 9/0527 439/440
5,795,188 A * 8/1998 Harwath ..... H01R 9/0524 439/583
5,879,191 A 3/1999 Burris
5,951,327 A * 9/1999 Marik ..... H01R 9/0527 439/607.44
6,010,289 A 1/2000 Distasio et al.
6,042,422 A 3/2000 Youtsey
6,352,439 B1 * 3/2002 Stark ..... F16L 37/008 174/655
6,380,483 B1 * 4/2002 Blake ..... H02G 3/0691 16/2.1
6,425,782 B1 7/2002 Holland
6,444,907 B1 * 9/2002 Kiely ..... H02G 3/0691 16/2.2

(Continued)

FOREIGN PATENT DOCUMENTS

WO 2007055871 A1 5/2007

*Primary Examiner* — Ross Gushi
(74) *Attorney, Agent, or Firm* — Thomas W. Galvani, P.C.; Thomas W. Galvani

(57) ABSTRACT

A coaxial cable connector includes a body having a longitudinal axis, a front end, an opposed rear end, and an interior. A pawl is carried in the interior of the body for engaging with a cable applied to the interior and preventing retraction of the cable after being so applied to the interior. The pawl is corrugated to allow the pawl to deform circumferentially when the cable is applied to the interior.

17 Claims, 8 Drawing Sheets

(56) References Cited

U.S. PATENT DOCUMENTS 6,642,451 B1 * 11/2003 Gretz ..... F16L 33/227 16/2.1
6,648,683 B2 11/2003 Youtesy
6,670,553 B1 * 12/2003 Gretz ..... H02G 3/0691 16/2.1
6,682,355 B1 * 1/2004 Gretz ..... H02G 3/0691 174/663
6,712,631 B1 3/2004 Youtsey
6,767,248 B1 * 7/2004 Hung ..... H01R 13/5205 439/578
6,776,657 B1 * 8/2004 Hung ..... H01R 9/05 439/439
6,910,919 B1 * 6/2005 Hung ..... H01R 9/0521 439/578
7,097,499 B1 * 8/2006 Purdy ..... H01R 9/0521 439/578
7,144,272 B1 12/2006 Burris et al.
7,156,671 B2 * 1/2007 Kauth ..... H01R 4/66 439/583
7,261,594 B2 * 8/2007 Kodama ..... H01R 13/5808 439/578
7,275,957 B1 * 10/2007 Wlos ..... H01R 9/0527 439/583
7,288,002 B2 * 10/2007 Rodrigues ..... H01R 9/0521 439/439
7,364,462 B2 * 4/2008 Holland ..... H01R 9/0527 439/578
7,377,809 B2 5/2008 Dyck
7,387,531 B2 * 6/2008 Cook ..... G01R 31/021 439/578
7,404,373 B2 7/2008 Youtsey
7,432,452 B2 * 10/2008 Gardner ..... H01R 24/564 16/2.1
7,461,870 B2 * 12/2008 Blake ..... H02G 3/0691 174/481
7,480,991 B2 * 1/2009 Khemakhem ..... H01R 9/032 29/857
7,510,432 B2 3/2009 Entsfellner
7,527,524 B1 5/2009 Coleman et al.
RE41,044 E * 12/2009 Hung ..... H01R 9/05 439/439
7,635,283 B1 * 12/2009 Islam ..... H01R 9/05 439/583
7,727,013 B1 * 6/2010 Paynter ..... H01R 9/0527 439/578
7,736,180 B1 * 6/2010 Paynter ..... H01R 4/5083 439/441
7,753,727 B1 7/2010 Islam et al.
7,803,018 B1 * 9/2010 Islam ..... H01R 24/564 439/578
7,806,724 B2 * 10/2010 Paynter ..... H01R 9/0521 439/578
7,819,698 B2 * 10/2010 Islam ..... H01R 9/05 439/578
7,824,214 B2 * 11/2010 Paynter ..... H01R 9/0521 439/578
7,934,953 B1 5/2011 Solis
7,934,955 B1 * 5/2011 Hsia ..... H01R 9/0524 439/578
7,934,956 B1 * 5/2011 Hsia ..... H01R 9/0524 439/460
7,967,634 B1 * 6/2011 Hsia ..... H01R 9/0524 439/271
7,976,339 B2 7/2011 Buck et al.
7,993,159 B2 * 8/2011 Chawgo ..... H01R 9/0524 439/584
7,997,930 B2 8/2011 Ehret et al.
8,029,316 B2 10/2011 Snyder et al.
8,109,786 B2 * 2/2012 Lee ..... H01R 4/4818 439/578
8,430,688 B2 * 4/2013 Montena ..... H01R 24/564 439/578
8,444,433 B2 5/2013 Snyder et al.
8,449,325 B2 * 5/2013 Wild ..... H01R 24/564 439/578
8,469,739 B2 6/2013 Rodrigues et al.
8,579,658 B2 11/2013 Youtsey
8,585,439 B2 11/2013 Amidon et al.
8,632,360 B2 * 1/2014 Tremba ..... H01R 9/0524 439/578
8,657,626 B2 * 2/2014 Duval ..... H01R 13/5205 439/583
8,690,603 B2 4/2014 Bence et al.
8,753,147 B2 6/2014 Montena
8,766,109 B2 * 7/2014 Duval ..... H01R 13/59 174/650
8,803,008 B2 * 8/2014 Chavan ..... H02G 3/0691 174/655
8,840,429 B2 9/2014 Thomas et al.
8,894,440 B2 11/2014 Rodrigues et al.
8,915,751 B2 12/2014 Wood
8,944,846 B2 2/2015 Lee
9,039,446 B2 5/2015 Youtsey
9,040,822 B2 5/2015 Nieto Lopez
9,048,599 B2 * 6/2015 Burris ..... H01R 24/38
9,071,019 B2 6/2015 Burris et al.
9,083,113 B2 7/2015 Wild et al.
9,088,078 B2 * 7/2015 Youtsey ..... H01R 9/0527
9,231,388 B2 * 1/2016 Chavan ..... H02G 1/00
9,257,762 B1 * 2/2016 Hsia ..... H01R 13/5816
9,257,780 B2 2/2016 Thomas et al.
9,276,363 B2 * 3/2016 Wild ..... H01R 24/564
9,281,611 B2 * 3/2016 Glick ..... H01R 13/5804
9,300,094 B2 * 3/2016 Youtsey ..... H01R 9/0527
9,431,815 B1 * 8/2016 Findley ..... H02G 3/0641
9,496,661 B2 11/2016 Purdy et al.
9,722,330 B2 * 8/2017 Edmonds ..... H01R 9/0518
9,722,351 B2 * 8/2017 Youtsey ..... H01R 9/0527
9,876,288 B2 * 1/2018 Youtsey ..... H01R 9/0524
2002/0164900 A1 11/2002 Youtsey
2003/0114112 A1 6/2003 Strater et al.
2004/0048514 A1 3/2004 Kodaira
2004/0069522 A1 * 4/2004 Jackson ..... H02G 3/065 174/660
2004/0259416 A1 * 12/2004 Kodama ..... H01R 9/0518 439/578
2005/0148236 A1 7/2005 Montena
2006/0015921 A1 1/2006 Vaughan
2006/0199431 A1 * 9/2006 Paynter ..... H01R 9/0524 439/578
2006/0252309 A1 * 11/2006 Kodama ..... H01R 13/5808 439/578
2007/0020973 A1 * 1/2007 Sattele ..... H01R 13/627 439/101
2008/0284163 A1 * 11/2008 Proulx ..... F16L 33/22 285/243
2009/0053928 A9 2/2009 Entsfellner
2009/0215306 A1 * 8/2009 Hanks ..... H01R 4/5033 439/427
2010/0084854 A1 * 4/2010 Sathyanarayana ... H02G 3/0691 285/84
2010/0125877 A1 5/2010 Wells et al.
2010/0223651 A1 9/2010 Wang
2010/0261380 A1 10/2010 Skeels et al.
2010/0297875 A1 11/2010 Purdy et al.
2012/0021642 A1 1/2012 Zraik
2012/0270439 A1 * 10/2012 Tremba ..... H01R 9/0524 439/578
2012/0295464 A1 * 11/2012 Youtsey ..... H01R 13/622 439/320
2012/0329311 A1 * 12/2012 Duval ..... H01R 13/59 439/449
2013/0143439 A1 * 6/2013 Nugent ..... H01R 9/0518 439/585
2013/0330967 A1 12/2013 Youtsey
2014/0248798 A1 * 9/2014 Youtsey ..... H05K 999/99 439/584
2014/0342594 A1 11/2014 Montena
2015/0007246 A1 1/2015 Ariesen
2015/0050825 A1 2/2015 Krenceski et al.

(56) References Cited

U.S. PATENT DOCUMENTS

| | | | |
|---|---|---|---|
| 2015/0118901 | A1 | 4/2015 | Burris |
| 2015/0162675 | A1 | 6/2015 | Davidson, Jr. et al. |
| 2015/0180141 | A1 | 6/2015 | Wei |

* cited by examiner

COAXIAL CABLE CONNECTOR WITH AN EXPANDABLE PAWL

FIELD OF THE INVENTION

The present invention relates generally to electrical equipment, and more particularly to coaxial cable connectors.

BACKGROUND OF THE INVENTION

Coaxial cables transmit radio frequency ("RF") signals between transmitters and receivers and are used to interconnect plants and provider equipment with electronic components such as televisions, cable boxes, DVD players, satellite receivers, modems, and other electrical devices having a coaxial port. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors before they may be coupled to electrical devices. Connectors typically have a connector body, a coupling nut or threaded fitting mounted for rotation on an end of the connector body, a bore extending into the connector body from an opposed end to receive the coaxial cable, and an inner post within the bore coupled in electrical communication with the fitting.

There are many different types of coaxial cable connectors, and each type has its own set of advantages and disadvantages. For example, generally, most connectors are crimped onto a prepared end of a coaxial cable with a tool to apply the connector to the coaxial cable. Crimping can provide a very secure fit, but occasionally results in a crushed coaxial cable which delivers a signal degraded by leakage, interference, or poor grounding. As another example, while some coupling nuts of connectors are so tightly mounted to the connector body that threading the connector onto the post of an electrical device can be incredibly difficult, other connectors have fittings that are mounted too loosely and the electrical connection between the fitting and the inner post can be disrupted when the fitting moves off of the post. Still further, some connectors, if applied too loosely to the cable itself, will actually come off of the cable, completely severing the RF connection between the transmitter and the electrical device. Yet further, connectors typically must be installed with a tool onto a cable, and for those that do not require installation tools, a good quality connection is very difficult to achieve between the cable and the connector. Other cable connectors can be pushed onto the cable, or onto the coaxial port, but such connectors do not always provide a secure fit onto the cable or the port. Still other connectors are susceptible to water and moisture ingress. An improved connector for coaxial cables is needed.

SUMMARY OF THE INVENTION

An exemplary coaxial cable connector includes a body having a longitudinal axis, a front end, an opposed rear end, and an interior. A pawl is carried in the interior of the body for engaging with a cable applied to the interior and preventing retraction of the cable after being so applied to the interior. The pawl is corrugated to allow the pawl to deform circumferentially when the cable is applied to the interior.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
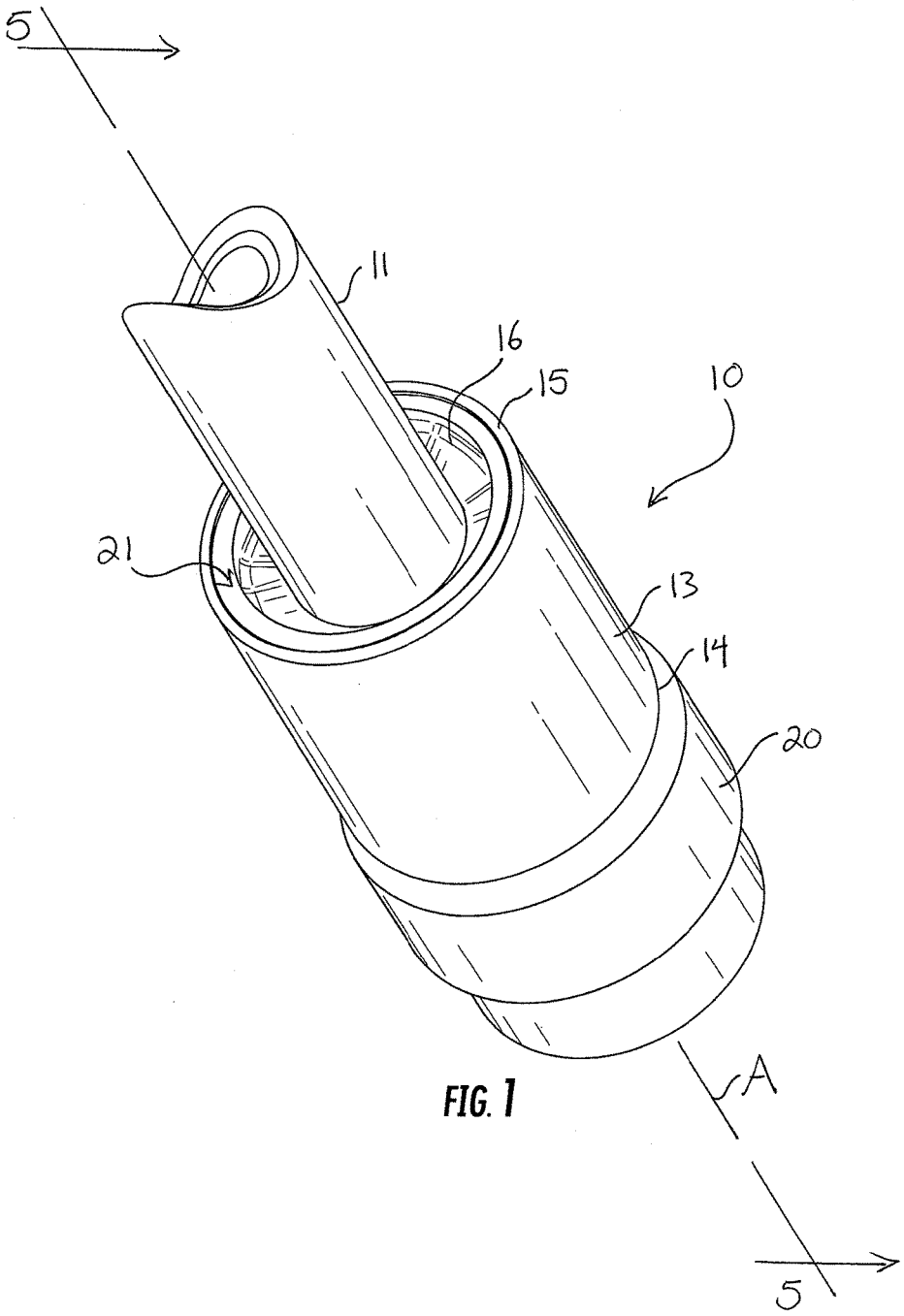
FIGS. 1 and 2 are rear and exploded rear perspective views of a coaxial cable connector with an expandable pawl.

Reference now is made to the drawings, in which the same reference characters are used throughout the different figures to designate the same elements. FIG. 1 illustrates a coaxial cable connector 10 constructed and arranged in accordance with the principle of the invention, as it would appear in an applied condition on a coaxial cable 11 from a rear perspective. The cable 11 is exemplary of a conventional coaxial cable, such as an RG59 or RG6 coaxial cable, and includes an inner conductor 12, shown in FIG. 5C extending out of the connector 10, for the communication of RF signals. The connector 10 includes a cylindrical body 13 having opposed front and rear ends 14 and 15 and a coaxial threaded fitting or coupling nut 20 mounted for rotation to the front end 14 of the body 13. A longitudinal axis A extends through the center of the connector 10 and through the body 13, and each of the connector 10, the body 13, and the coupling nut 20 have rotational symmetry with respect to the longitudinal axis A.

Figure 5A:
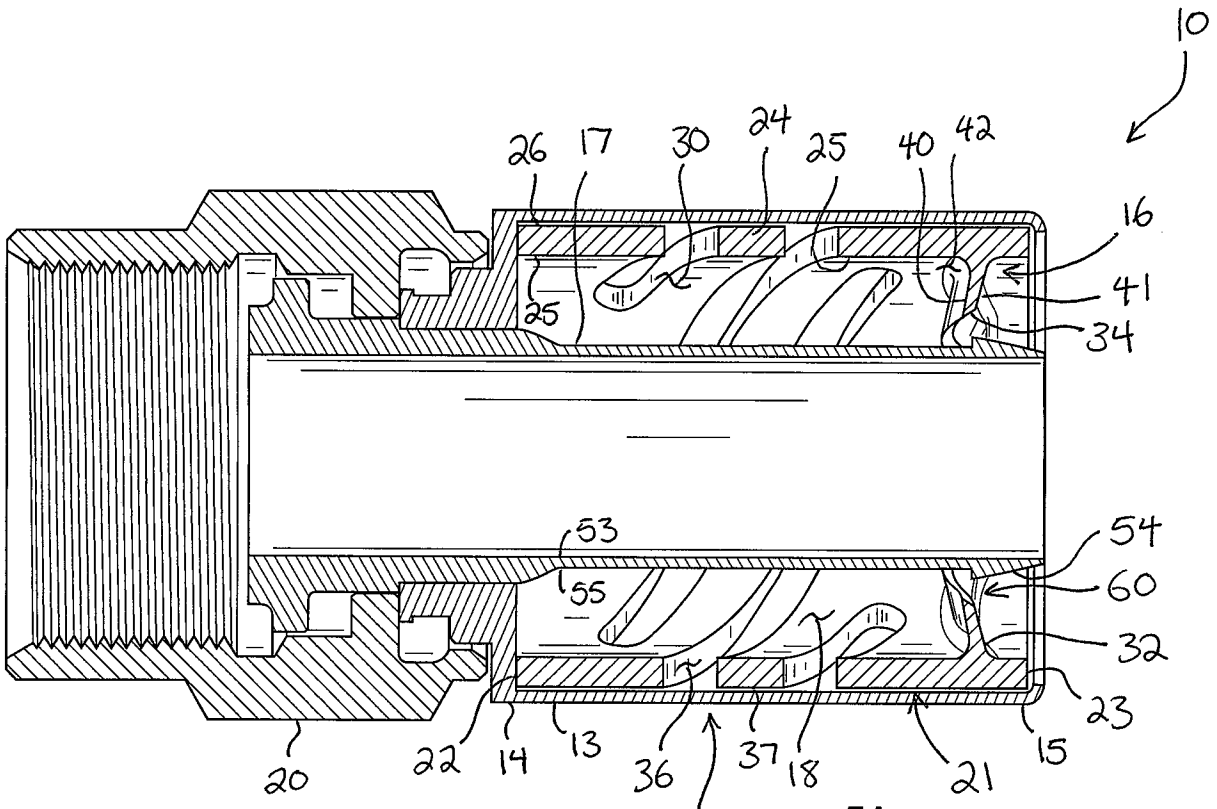
FIGS. 5A-5C are section views taken along the line 5-5 in FIG. 1.
Figure 5B:
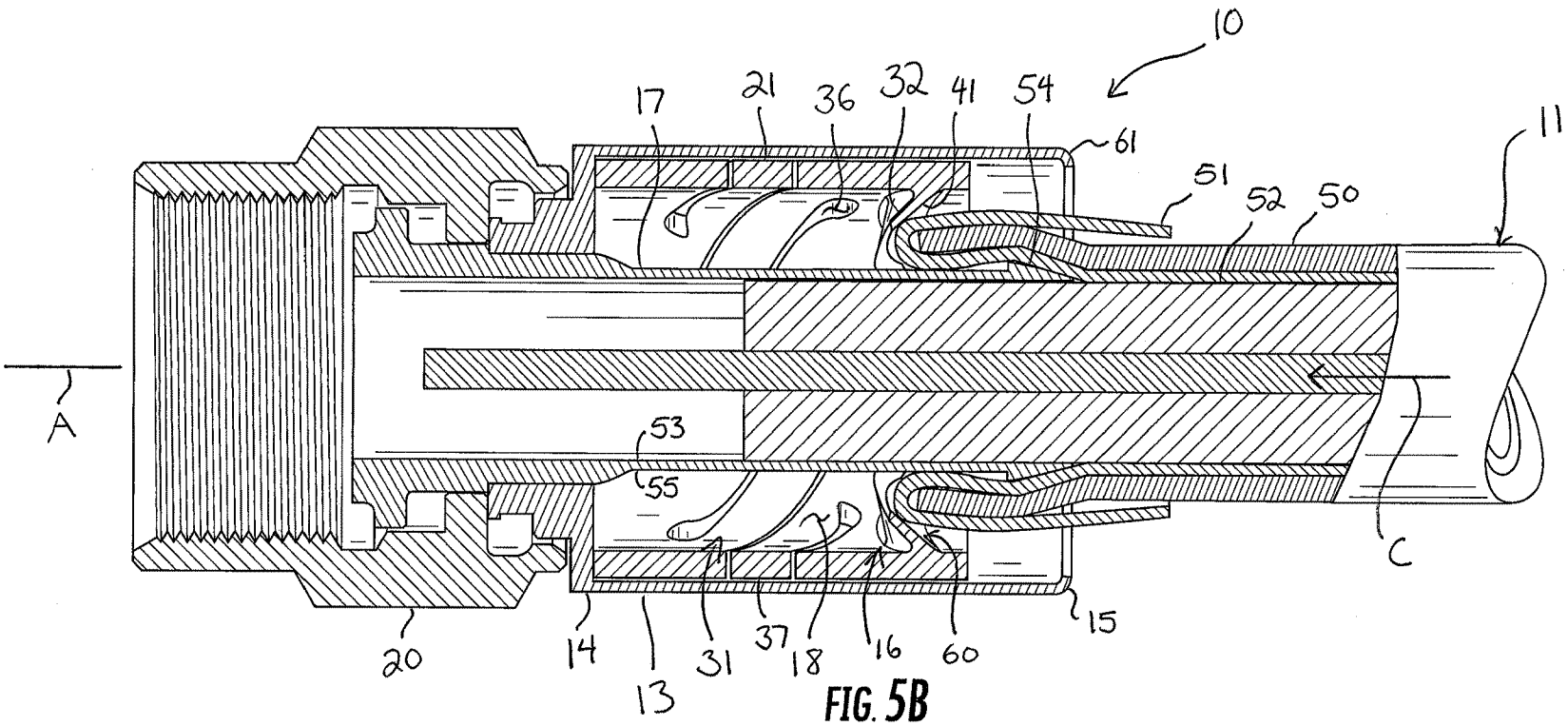
Figure 5C:
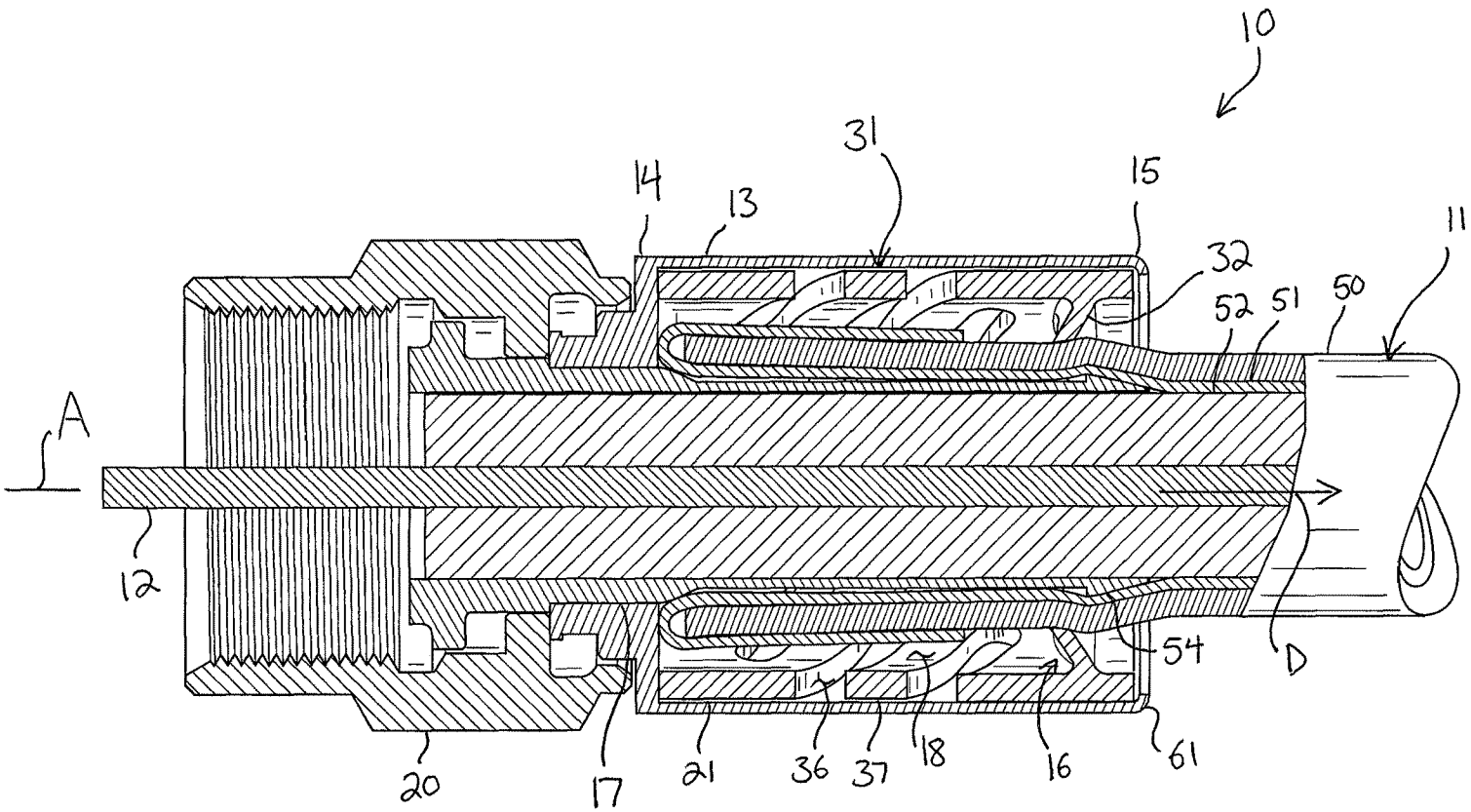
Figure 6:
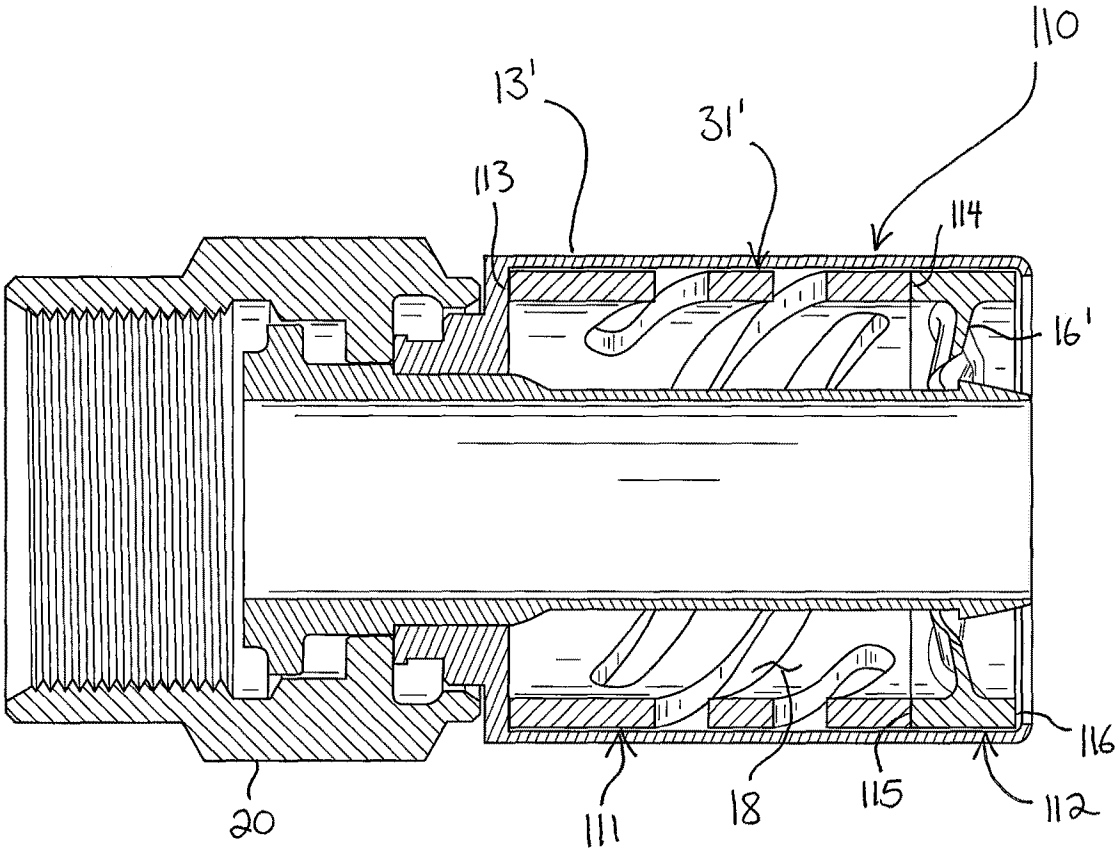
FIG. 6 is a section view, similar to FIG. 5A, showing an alternate embodiment of a coaxial cable connector with an expansion pawl.

FIGS. 1-5C show one embodiment of the connector 10; FIG. 6 shows an alternate embodiment of a similar connector 110. Both embodiments carry an expandable pawl 16 useful for forming a seal around the cable 11 and for preventing removal of the cable 11 from the connectors 10 and 110. FIGS. 1-6 show exemplary embodiments of coaxial cable connectors, and it should be understood that the expandable pawl described herein could be used in connectors of many styles having certain structural elements and features in common with the embodiments of connectors 10 and 110.

Figure 2:
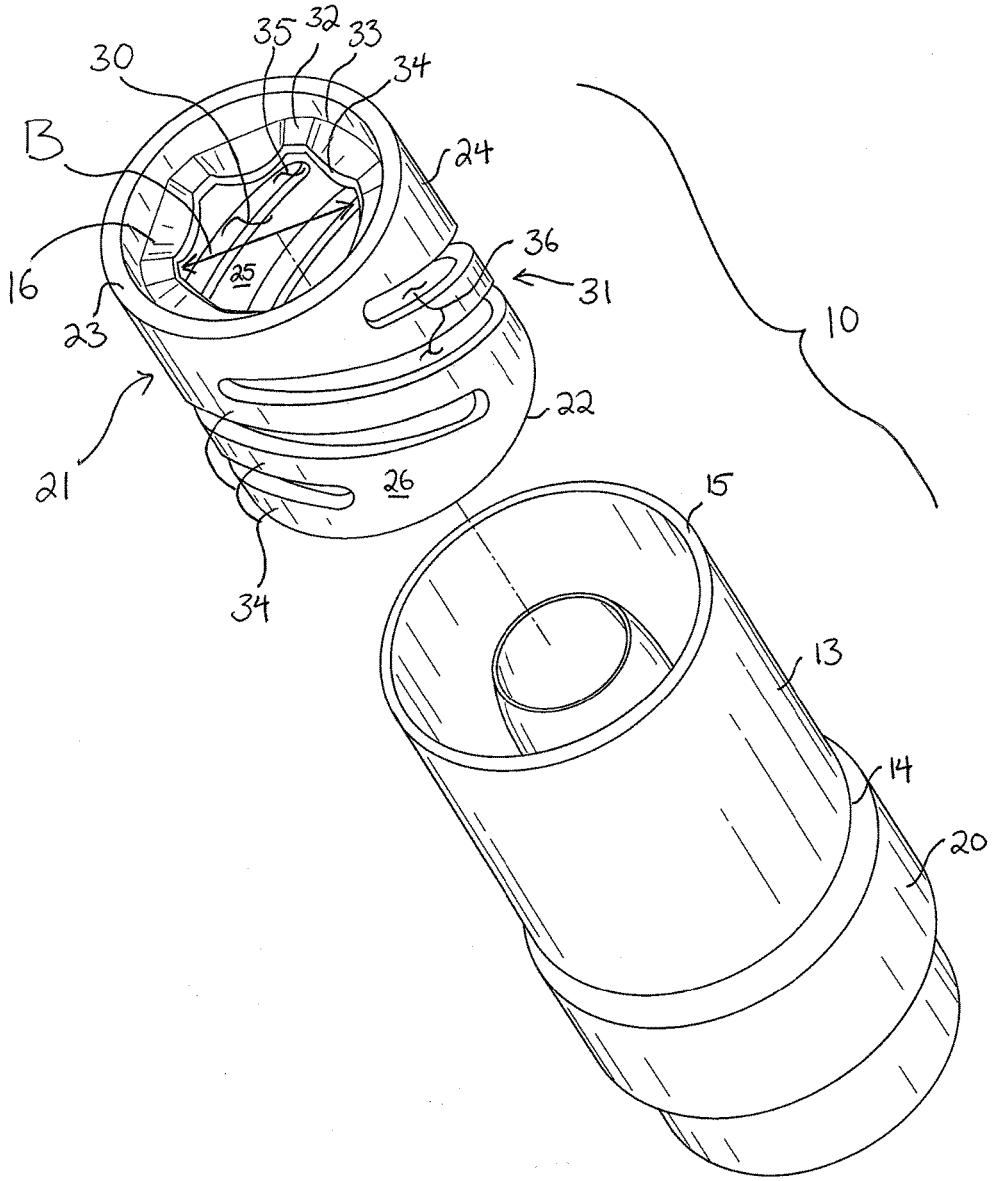

In the embodiment shown in FIGS. 1-5C, the pawl 16 is formed on an inner sleeve 21, carried within the interior 18 of the body 13. FIG. 2 is an exploded rear perspective view showing the inner sleeve 21 removed from the connector 10. The inner sleeve 21 has an open front end 22, an opposed open rear end 23, and a cylindrical sidewall 24 extending between the front and rear ends 22 and 23 and including opposed inner and outer surfaces 25 and 26. The inner surface 25 of the sleeve 21 bounds and defines a bore 30 having a consistent inner diameter through the sleeve 21 from the front end 22 through the rear end 23, which bore 30 is structured to closely receive the coaxial cable 11. The outer surface 26 has an outer diameter which is consistently larger than the inner diameter by a consistent thickness of the sidewall 24.

The sleeve 21 is provided with a compression assembly 31 formed integrally in the sidewall 24, and including a plurality of helical slots 36 formed through the sidewall 24 from the inner surface 25 to the outer surface 26, defining diagonal structural ribs 37 of the sidewall 24. The slots 36 between the ribs 37 allow the compression assembly 31 to move between an uncompressed condition (as shown in FIGS. 5A and 5C) and a compressed condition (as shown in FIG. 5B) in response to axial application of the cable 11 into the interior 18 of the connector 10 so as to engage the cable 11 to create a secure coupling between the connector 10 and the cable 11. When the cable 11 is introduced into the bore 30 of the sleeve 21, the slots 36 collapse in response to axial compression of the sleeve 21 between the front and rear ends 22 and 23 thereof, with the ribs 37 moving together as the front and rear ends 22 and 23 move together. Unless otherwise indicated, as the term is used here "axial" means extending or aligned parallel to the longitudinal axis A, and the term "radial" means aligned generally along a radius extending outward from the longitudinal axis A.

The compression assembly 31 shown herein is simply a means for allowing the sleeve 21 to axially compress so that the rear ends 23 of the sleeve 21 moves forwardly in the interior 18 of the connector 10 with respect to the rear end 15 of the body 13 of the connector 10. One having ordinary skill in the art will readily appreciate that other embodiments of the compression assembly 31 may be used, such as with slots 36 in alternate orientations, as disclosed in U.S. Pat. No. 9,088,078.

As shown in FIG. 2, the pawl 16 includes a lip 32 and a hinge 33 formed on the inner surface 25. The hinge 33 is a continuous annular living hinge between the lip 32 and the inner surface 25 of the sidewall 24. The lip 32 is thereby a continuous annular extension of the sidewall 24 projecting radially inwardly and forwardly toward the front end 22 of the sleeve 21. The lip 32 has an inner edge, or free edge 34, bounding and defining an opening 35 into the bore 30 from the rear end 23 which has a diameter B. Thus, the lip 32 is pivoted on the hinge 22 and terminates in the free edge 34.

The lip 32 and hinge 33 together define the pawl 16 that moves between an initial, raised condition, in which the lip 32 is ready to receive application of the cable 11 (shown in FIG. 5A), a deflected condition in response to application of the cable 11 to the connector 10 in which the lip 32 accommodates the cable 11 (shown in FIG. 5B), and an engagement condition in response to retraction of the cable 11 with respect to the connector 10 in which the lip 32 engages the cable 11 and prevents removal of the cable 11 from the sleeve 21 (FIG. 5C). As will be explained, the lip 32 moves into the deflected condition and the sleeve 21 compresses axially in response to the cable 11 being applied to the interior 18 of the sleeve 21 so as to engage the cable 11, consistent with the mechanism of a pawl. A pawl is a pivoted lever adapted to engage with an element to allow forward movement of the element and prevent backward movement of the element. Here, in addition to other functions and advantages, the lip 32 and hinge 33 function as such a pawl formed in a continuous and annular arrangement within the body 13 of the connector 10.

Figure 3A:
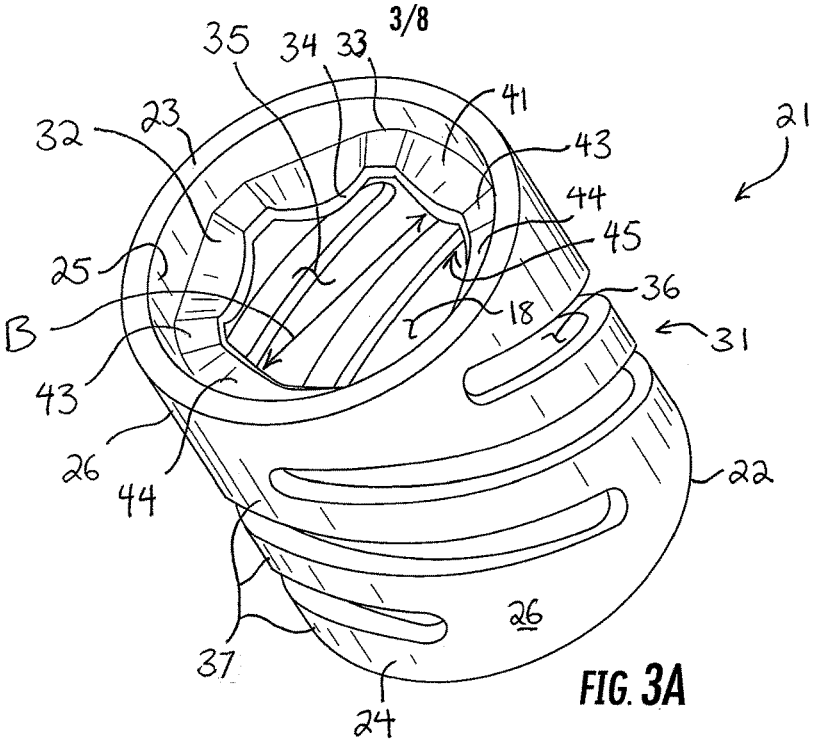
FIGS. 3A and 3B are isolated views of an inner sleeve of the connector of FIG. 1.
Figure 3B:
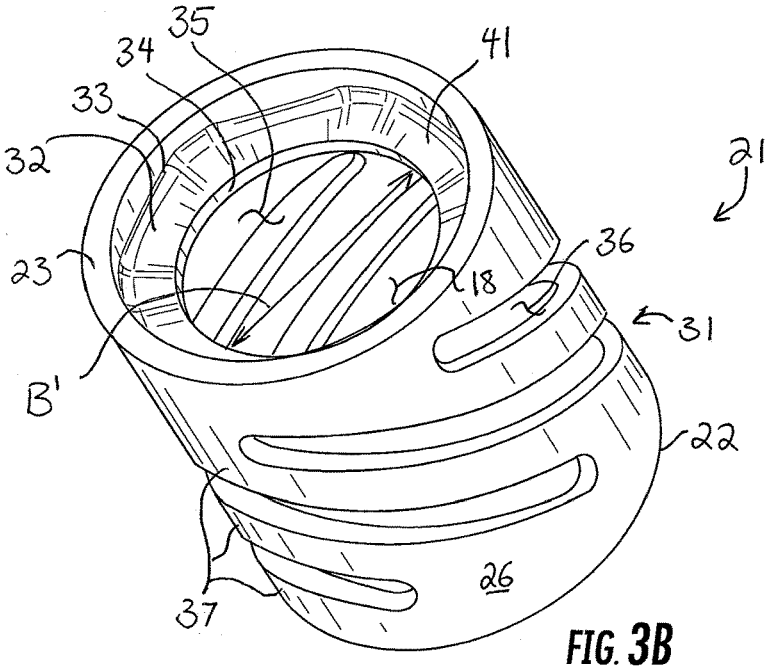
Figure 4A:
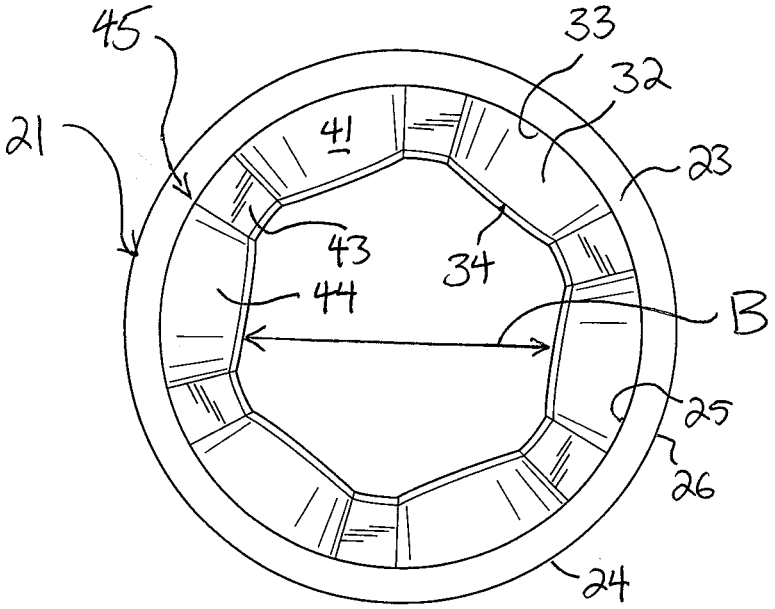
FIGS. 4A and 4B are isolated rear views of the inner sleeve.
Figure 4B:
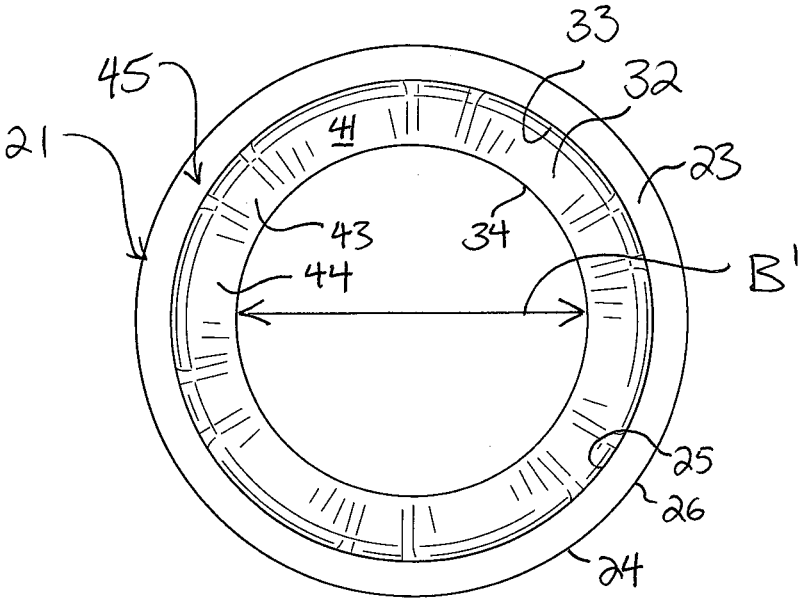

Referring now to isolated views of the sleeve 21 in FIGS. 3A and 3B, and also to the section view in FIG. 5A, the lip 32 has a continuous inclined rear face 41 directed toward the rear end 23 of the sleeve 21 and an opposed continuous forward face 40 directed toward the front end 22. The forward and rear faces 40 and 41 meet at the free edge 34. The free edge 34 extends continuously around the lip 32 and is directed radially inward, into the interior 18. In an embodiment, the lip 32 is constructed of a material or combination of materials having semi-rigid, flexible, and elastic material characteristics, allowing the lip 32 to flex radially outward along a living hinge at the inner surface 25 toward the sidewall 24, resist flexing and buckling radially inward toward the center of the sleeve 21, and then bias back toward its original position after flexing. In this way, the lip 32 operates as a pawl to deflect and allow forward movement of the cable 11 and to then prevent rearward movement of the cable 11 from the connector 10. In other embodiments, the lip 32 is constructed of rigid or semi-rigid materials and also flexible materials, as will be described, allowing portions of the lip 32 to flex radially and circumferentially. An annular deflection space 42 lies between the forward face 40 and the inner surface 25 of the sidewall 24 to accommodate the lip 32 as it flexes radially outwardly into the deflected condition.

As seen in FIG. 3A, the lip 32 is corrugated; it is formed with many alternating ridges 43 and furrows 44, one set of which defines a corrugation 45. There are several corrugations 45 formed on the lip 32. The corrugations 45 are in a radial direction because the ridges 43 and furrows 44 extend along the lip 32 between the hinge 33 and the free edge 34, which is in a generally radial direction. The lip 32 is formed with approximately seven ridges 43 (five are at least visible) and seven furrows 44 (six are at least partially visible). Each ridge 43 extends radially inwardly from the hinge 33 and is generally flat. The furrows 44 extend between each ridge 43. The furrows 44 are scalloped; in the raised condition of the pawl 16, the furrows 44 are contoured such that they bow toward the front end 22. In other words, they are convex with respect to the front end 22 and concave with respect to the rear end 23. While in the raised condition of the pawl 16, the ridges 43 are coplanar and lie flat within a plane normal to the sidewall 24 of the sleeve 21, and the furrows 44 bow outward and forward of the plane toward the front end 22.

The corrugations 45 provide the lip 32 with the unique ability to expand elastically. The free edge 34 has a circumference dimension which extends along the ends of both the ridges 43 and the furrows 44. That dimension remains constant in all arrangements of the lip 32, but because it is scalloped with the free edge 34 in the raised condition of the pawl 16, it allows the lip 32 to move uniquely.

In FIG. 3A, the pawl 16 is in the raised condition, as it would appear before a cable 11 has been applied to the connector 10 at all. The ridges 43 are directed inward, the furrows 44 are scalloped, and the lip 32 assumes its inner diameter B, with the free edge 34 having a scalloped or corrugated profile about the lip 32. The scalloped shape of the free edge 34 is clearly shown in FIG. 4A, as it would appear when the cable 11 is not applied to the interior 18 of the connector 10.

When a cable 11 is applied, the pawl 16 is moved into the deflected condition. FIG. 3B shows the sleeve 21 in isolation as it would appear during the deflected condition of the pawl 16. Briefly, when the cable 11 is applied to the connector 10, the cable 11 causes the pawl 16 to deflect forward while also expand radially outward. The ridges 43 generally maintain their shape, but alter their orientation, pivoting forwardly and radially outwardly on the hinge 33 in response to introduction of the cable 11. The furrows 44 between the ridges 43, however, deform when they pivot forwardly and radially outwardly on the hinge 33. The furrows 44 tend to flatten, with the sides proximate to the ridges 43 moving forward and outward more than the middle portions of the furrows 44. The free edge 34 comes into alignment along and across all of the ridges 43 and furrows 44, and as such, the free edge 34 assumes the circular shape shown in FIG. 3B, and the lip 32 has a modified inner diameter B', which is slightly larger than the diameter B. In this deflected condition, the lip 32 tightly fits against the cable 11; the free edge 34 has a circular shape, best seen in FIG. 4B, which seals against the cable 11 to mitigate liquid and moisture ingress and which also prevents retraction of the cable 11 from the connector 10.

With reference to FIGS. 5A-5C now, to apply the connector 10 onto the cable 11, the cable 11 is stripped and prepared according to well-known and conventional techniques, including stripping off a portion of a jacket 50 and folding back a flexible shield 51 over the jacket 50 to expose a dielectric 52 encircling the inner conductor 12 at an exposed forward end of the coaxial cable 11. The forward end of the cable 11 is introduced into the connector 10 by taking up the cable 11, such as by hand, and aligning the inner conductor 12 with the longitudinal axis A, presenting the forward end toward the rear end 15 of the body 13 of the connector 10, and then passing the forward end through the rear end 15 along a direction generally indicated by the arrowed line C in FIG. 5B. The inner conductor 12 and the dielectric 52 enter an inner post 17 of the connector 10 and move laterally in contact against an inner surface 53 of the inner post 17.

The shield 51 of the cable 11, which is curled back over the jacket 50, moves against and over a ridge 54 on an outer surface 55 of the inner post 17, and encounters the rear face 41 of the lip 32. The lip 32 is initially directed radially inward in the raised condition of the pawl 16, as shown in FIG. 5A. The jacket 50, and the shield 51 folded back over the jacket 50, have a thickness which is greater than the width of an annular gap 60 between the free edge 34 of the lip 32 and the ridge 54, so that the lip 32 and the ridge 54 cooperate to define an impediment or interference to the advancement of the cable 11 along the direction of arrowed line C.

However, application of an increased amount of axial force along arrowed line C causes the cable 11 to advance through the annular gap 60, deflecting the lip 32 along line C and radially outward from the raised condition of FIG. 5A toward the deflected condition of FIG. 5B. The flexible material characteristic and the corrugations 45 formed in the lip 32 allow the lip 32 to deform in response to the increased application of axial force imparted by advancement of the cable 11 along line C. In embodiments in which the ridges 43 and furrows 44 are both flexible, the ridges 43 and furrows 44 both flex and deform. In embodiments in which the ridges 43 are rigid or semi-rigid and the furrows 43 are flexible, only the furrows 43 flex, or the furrows 43 flex and the ridges slightly flex. The forward face 40 of the lip 32 is moved closer to the inner surface 25 of the sleeve 21, reducing the deflection space 42 and directing the free edge 34 toward the front end 14 of the body 13.

Thus, as the lip 32 moves toward the deflected condition, the sleeve 21, to which the lip 32 is integrally formed, compresses in the axial direction, as shown in FIG. 5B, in response to continued forward application of the cable 11 into the connector 10. In the embodiment of the sleeve 21 shown in these drawings, the compression assembly 31 provides the sidewall 24 of the sleeve 21 with axial compression characteristics to accommodate the compression. In other embodiments of sleeves 21 that have a different compression assembly or have no compression assembly, the sleeve may simply slide forward within the body 13 or otherwise move or not move in response to the application of the cable 11 into the connector 10. Compression of the sleeve 21 causes the lip 32 to move down the body 13 toward the front end 14 and away from the ridge 54 of the inner post 17. Thus, as the cable 11 moves into the connector 10, the sleeve 21 compresses and the lip 32 on the sleeve 21 yields or deflects.

When the lip 32 yields and deflects, the tight clearance between the lip 32 and the ridge 54 is relaxed because the lip 32 is moved out of its original, opposed position with respect to the ridge 54; the lip 32 is no longer opposite the ridge 54 and so the gap 60 therebetween is enlarged. The slightly malleable jacket 50 and shield 51 together move over the ridge 54 and under the lip 32, navigating through the now-enlarged gap 60.

Forward movement of the cable 11 is continued until the inner conductor 12 extends just into the coupling nut 20. At this point, the sleeve 21 is moved into the compressed condition fully, in which the compression assembly 31 can no longer be axially compressed in response to the advancement of the cable 11 through the sleeve 21, as seen in FIG. 5B. Nevertheless, advancement of the cable 11 is further continued until the inner conductor 12 is just beyond the coupling nut and the shield 51 is against the front end 14 cylindrical body 13, as in FIG. 5C. Once the cable 11 has been completely inserted into the connector 10, the lip 32 is flexed and deformed into the deflected condition thereof within the deflection space 42 in response to the jacket 50 and shield 51 having been passed against and beyond the lip 32. In the deflected condition, the forward face 41 of the lip 32 is moved toward the inner surface 25 of the sleeve 21, the free edge 34 of the lip 32 is turned forward toward the front end 22 of the sleeve 21, the free edge 34 protrudes slightly into the jacket 50 and engages with the jacket 50 and the rear face 40 of the lip 32 is in contact with the jacket 50

Slight retraction of the cable 11 with respect to the body 13 of the connector 10 along line D moves the cable 11 and sleeve 21 rearwardly, so that the sleeve 21 is in the uncompressed condition seen in FIG. 5C and the rear end 23 of the sleeve 21 is at the rear end 15 of the body 13. The compression assembly 31 lengthens and returns to its original condition. The rear end 23 of the sleeve 21 advances back to the rear end 15 of the body 13, and the rear end 23 is there limited from further movement along line D by the inwardly-turned mouth 61, which captures and prevents the rear end 23 of the sleeve 21 from moving out of the body 13.

The slight retraction causes the lip 32 to turn or buckle inwards slightly, catching and binding with the jacket 50 in an engagement position. In this position, the lip 32 forms an engagement element binding and permanently coupling the sleeve 21 to the cable 11 and preventing rearward movement or retraction of the cable 11 with respect to the sleeve 21 along line D in FIG. 5C. With the cable 11 coupled to the sleeve 21, and the sleeve 21 prevented from rearward movement beyond the mouth 61 of the body 13, the cable 11 is prevented from removal out of the connector 10 and is prevented from removal off of the inner post 17. This defines the engagement condition of the pawl 16. The lip 32 is maintained in the engagement condition thereof, engaged with the jacket 50 and crimping the cable 11 against the ridge 54, maintaining the position of the cable 11 with respect to the inner post 17, and maintaining electrical contact and communication between the shield 51 and the inner post 17. The connector 10 is now applied to the cable 11 and ready for operation. Though described as a series of steps, application of the cable 11 to the connector 10 as described herein takes approximately one second and is accomplished in a single, continuous, fluid, and forward motion.

FIG. 6 shows an alternate embodiment. The connector 110 shown in FIG. 6 is identical to the connector 10 in nearly all structural elements and features except for the sleeve. As such, the various structural elements and features of the connector 110 are identified with the same reference characters used for the connector 10 but are marked with a prime ("") symbol to distinguish them. Within the body 13' of the connector 110, there are two sleeves: a front sleeve 111 and a rear sleeve 112 just behind. The front and rear sleeves 111 and 112 are similar to a severed version of the sleeve 21; the front sleeve 111 has a front end 113, an opposed rear end 114, and the compression assembly 31' therebetween. The rear sleeve 112 has a front end 115, an opposed rear end 116, and the pawl 16 carried therebetween. The rear sleeve 112 is a slender ring and carries only the pawl 16' and not the compression assembly 31'. The front end 115 of the rear sleeve 112 makes full contact against the rear end 114 of the front sleeve 111.

The rear sleeve 112, as a slender ring, is capable of being inserted within the bodies of coaxial cable connectors equipped with sleeves, so that the rear sleeve 112 may provide such connectors with an engagement pawl 16'. The rear sleeve 112 moves with the front sleeve 111, similarly to the sleeve 12 in the connector 10. Indeed, the pawl 16' functions identically to the sleeve 16 when a cable 11 is applied to the connector 110. As such, description of its operation is unnecessary.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A coaxial cable connector comprising:

a body having a longitudinal axis, a front end, an opposed rear end, and an interior; and a pawl carried in the interior of the body for engaging with a cable applied to the interior and preventing retraction of the cable after being so applied to the interior, the pawl includes a continuous annular lip in the interior, wherein the lip is formed to a living hinge on which the lip pivots;

wherein the pawl is corrugated to allow the pawl to deform circumferentially when the cable is applied to the interior.

2. The connector of claim 1, wherein the pawl includes at least a ridge and at least a furrow, each formed in the pawl and extending radially along the pawl.

3. The connector of claim 1, wherein the pawl has a free edge which is scalloped when the cable is not applied to the interior.

4. The connector of claim 3, wherein the free edge is circular when the cable is applied to the interior.

5. The connector of claim 1, further comprising an inner sleeve carried within the body, wherein the pawl is formed to the inner sleeve.

6. A coaxial cable connector comprising:

a body having a longitudinal axis, a front end, an opposed rear end, and an interior;

a corrugated pawl carried in the interior, the pawl including a continuous annular lip in the interior, and the lip formed to a living hinge on which the lip pivots, which pawl moves from a first condition to a second condition in response to application of a cable into the interior;

in the first condition of the pawl, the pawl defines an opening having a first dimension; and in the second condition of the pawl, the pawl defines a second dimension of the opening, wherein the second dimension is larger than the first dimension.

7. The connector of claim 6, wherein the pawl includes at least a ridge and at least a furrow, each formed in the pawl and extending radially along the pawl.

8. The connector of claim 6, wherein the pawl has a free edge which, in the first condition of the pawl, is scalloped.

9. The connector of claim 8, wherein, in the second condition of the pawl, the free edge of the pawl is circular.

10. The connector of claim 6, further comprising an inner sleeve carried within the body, wherein the pawl is formed to the inner sleeve.

11. A coaxial cable connector comprising:

a body having a longitudinal axis, a front end, an opposed rear end, and an interior;

a pawl carried in the interior of the body for engaging with a cable applied to the interior and preventing retraction of the cable after being so applied to the interior, wherein the pawl includes a continuous annular lip in the interior; and a corrugation formed in the pawl for allowing the pawl to expand circumferentially in response to application of the cable into the interior.

12. The connector of claim 11, wherein the corrugation includes a furrow formed in the pawl and extending radially along the pawl.

13. The connector of claim 12, wherein the corrugation includes ridges flanking the furrow.

14. The connector of claim 11, wherein the pawl has a free edge which is scalloped when the cable is not applied to the interior.

15. The connector of claim 14, wherein the free edge is circular when the cable is applied to the interior.

16. The connector of claim 11, further comprising an inner sleeve carried within the body, wherein the pawl is formed to the inner sleeve.

17. The connector of claim 11, further comprising an inner sleeve carried within the body, wherein the pawl is not formed to the inner sleeve.

* * * * *